United States Patent [19]

Yip

[11] Patent Number: 4,602,557

[45] Date of Patent: Jul. 29, 1986

[54] LIQUID BREWING CUP

[76] Inventor: John Yip, 1120 S. Garfield Ave., Monterey Park, Calif. 91754

[21] Appl. No.: 630,747

[22] Filed: Jul. 13, 1984

[51] Int. Cl.[4] ..... A47G 19/16; A47G 19/22; A47J 31/44

[52] U.S. Cl. ..... 99/279; 99/323; 206/0.5; 215/1 R; 215/100 R; 220/85 R; 229/1.5 B

[58] Field of Search ..... 206/0.5; 229/1.5 B; 215/1 R, 100 R; 99/295, 316–323, 279; 426/79–83; 220/85 R

[56] References Cited

U.S. PATENT DOCUMENTS

| | | | |
|---|---|---|---|
| 1,287,288 | 12/1918 | Gayton | 229/1.5 B |
| 1,651,485 | 12/1927 | Thesen . | |
| 1,665,080 | 4/1928 | Abbott . | |
| 1,702,243 | 2/1929 | Axtell | 99/319 X |
| 1,748,297 | 2/1930 | Matson | 99/317 |
| 1,886,415 | 11/1932 | Mitchell | 99/295 |
| 2,284,087 | 5/1942 | Ferguson | 99/319 X |
| 2,328,599 | 9/1943 | Armstrong | 99/319 X |
| 2,334,533 | 11/1943 | Armstrong | 99/295 |
| 2,530,124 | 11/1950 | Kieckhefer | 229/1.5 B |
| 2,879,613 | 3/1959 | De Mario | 40/2 |
| 2,889,035 | 6/1959 | Shaw | 206/0.5 |
| 3,237,550 | 3/1966 | Christopher | 206/0.5 X |
| 3,429,254 | 2/1969 | Rosen | 206/0.5 X |
| 3,705,659 | 12/1972 | Mackie | 215/1 C |
| 3,733,021 | 5/1973 | Levin | 229/1.5 B |
| 3,785,794 | 1/1974 | Hodges | 65/108 |
| 3,895,118 | 7/1975 | Rambold | 206/0.5 X |
| 3,899,599 | 8/1975 | Rambold | 206/0.5 X |
| 4,141,997 | 2/1979 | Syroka et al. | 206/0.5 X |
| 4,193,494 | 3/1980 | Green | 229/1.5 B X |
| 4,220,079 | 9/1980 | Sims | 215/1 R X |

FOREIGN PATENT DOCUMENTS

| | | | |
|---|---|---|---|
| 931533 | 7/1963 | United Kingdom | 99/322 |

*Primary Examiner*—William Price
*Assistant Examiner*—Sue A. Weaver
*Attorney, Agent, or Firm*—Henry M. Bissell

[57] ABSTRACT

The improved cup comprises a closed bottom and connected closed sidewall defining a central brewing liquid-retaining space and an open top. The liquid may be, for example, tea, herb tea, etc. The upper end of the sidewall defines an exposed rim having a brew bag string-retaining notch extending down therein. The notch prevents the entire length of the bag string and the bag string end tab from being inadvertently drawn down into the cup liquid during and after brewing of the liquid. Thus, there is no occasion to fish a wet bag string and tab from the liquid. Instead, the tab remains dry and accessible outside the cup, thus readily available for withdrawing the bag from the cup when desired. The notch can also serve as a vent hole for the cup when the cup is inverted after washing. The notch can be of any suitable string- and tab-retaining configuration. The portion of the rim defining it can be elastomeric and of crushable foamed plastic or the like so as to releasably grip the string and accommodate strings of various sizes. The cup is simple, inexpensive, durable and efficient.

8 Claims, 8 Drawing Figures

LIQUID BREWING CUP

BACKGROUND OF THE INVENTION

1. Field of the Invention

The present invention generally relates to receptacles and, more particularly, to an improved brewing cup featuring a bag string-retaining notch.

2. Description of the Prior Art

Natural tea bags and bags used for brewing herb teas and the like are usually connected by strings to terminal pull tabs. When tea is to be brewed, the bag is placed in a cup, with the tab hanging out of the cup. Unfortunately, when the brewing liquid is poured into the cup and/or when the liquid is agitated to facilitate brewing, the length of string and the tab frequently are inadvertently pulled down into the cup and settle at the bottom thereof. Such an accident can also later occur when sugar and/or cream is added to the cup and the cup contents are stirred. The soggy string and tab then must be fished out of the cup liquid in order to remove the brewing bag.

U.S. Pat. No. 2,879,613 addresses this problem by providing a special tab designed to snap onto a tea cup handle. However, handleless tea cups provide no means of retaining the tab. Moreover, standard tea bags have no such specially configured tabs. U.S. Pat. No. 1,665,080 discloses a tea bag with a stiff stirring rod connected thereto, again a construction unavailable with commercial tea bags.

Accordingly, there is a need for a simple and efficient means of retaining the brew bag tab dry and outside the cup until the bag is to be removed from the cup. Such means should not require the use of specially constructed tea bags which are not currently available.

Tea cups and the like are most frequently reusable and, after washing, they can be inverted and allowed to drain dry. However, during such a procedure, waste liquid inside of the cup has no escape exit, so that the interior of the cup usually is still wet when the outer surface thereof has already dried. It therefore would be desirable to be able to provide an improved cup construction capable of faster drying when inverted after washing.

SUMMARY OF THE INVENTION

The improved brewing cup of the present invention satisfies all the foregoing needs. The cup is substantially as set forth in the Abstract. Thus, the cup has a closed bottom and sidewall and an open top providing access to its central liquid-retaining space. The cup rim defines a notch extending downward from the rim, which notch is specially adapted to retain a brewing bag string and prevent inadvertent passage of a brewing bag string tab therethrough and into the cup. Thus, the notch is wide enough for the string and narrower than the tab. The notch can be of any suitable configuration, such as a vertical groove through the upper end of the rim, or such upper vertical component combined with another lower component to form a configuration such as a cross, inverted T, L, reverse N, K, H, T, J, keyhole, etc. The upper component of the configuration can, instead, be slanted or curved, so that the configuration can be a star, V, inverted V, Y, S, chevron, U, etc. The lower component can be wider than the upper component to provide a configuration such as that of a golf club, beaker, vase, arrow, etc.

In one embodiment, the portion of the rim defining the notch comprises an insert of resilient, flexible, memory-retaining elastomeric material which releasably grips the string and accommodates the strings of various diameters. In a further embodiment, that portion of the cup rim is formed of deformable or crushable foamed plastic or the like, so that in this instance also the string is releasably gripped, and strings of various sizes are accommodated.

The cup notch has the additional function of allowing access of air to the inside of the cup when it is inverted for draining after washing. The notch also allows wash liquid to drain from the cup interior while the cup is inverted, thereby speeding drying of the cup interior. More than one notch can be provided in the cup rim to receive strings of various diameters, etc. as needed.

BRIEF DESCRIPTION OF THE DRAWINGS

A better understanding of the present invention may be had from a consideration of the following detailed description, taken in conjunction with the accompanying drawings in which.

DETAILED DESCRIPTION

FIGS. 1-3

Figure 1:
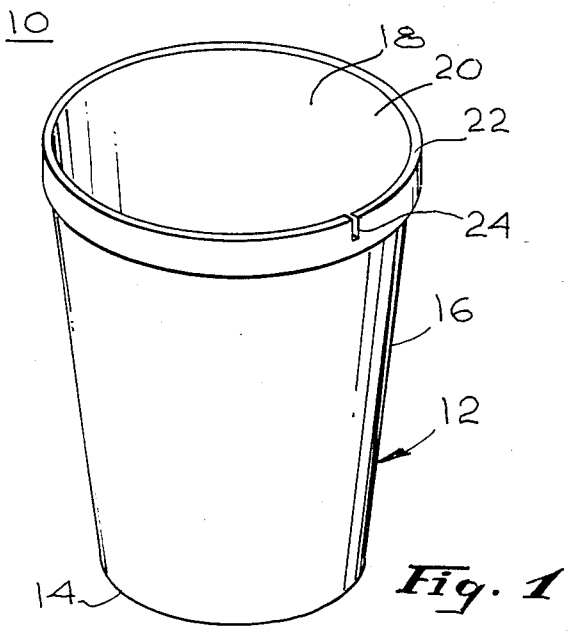
FIG. 1 is a schematic perspective view of a first preferred embodiment of the improved brewing cup of the present invention.

Now referring more particularly to FIG. 1 of the accompanying drawings, a first preferred embodiment of the improved brewing cup of the present invention is schematically depicted therein. Thus, cup 10 is shown which comprises a generally cylindrical or frusto-conical body 12 having a closed bottom 14 connected to an upraised continuous sidewall 16 to define a central liquid-retaining space 18 and an open top 20.

Figure 2:
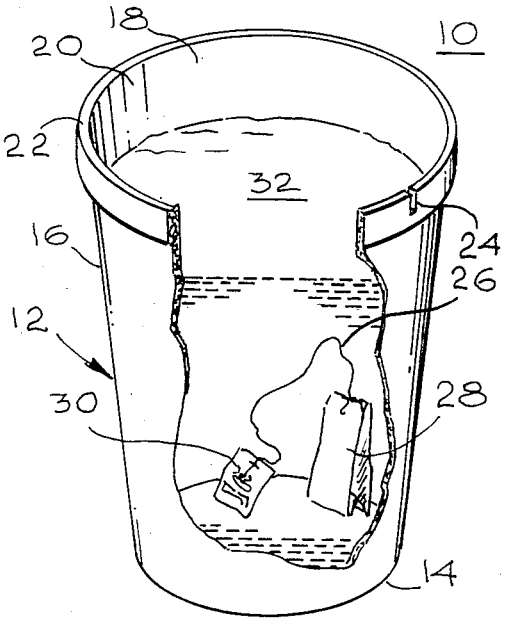
FIG. 2 is a schematic perspective view, partly broken away, showing the cup of FIG. 1 with a tea bag, string and tab in the bottom of the liquid in the cup.
Figure 3:
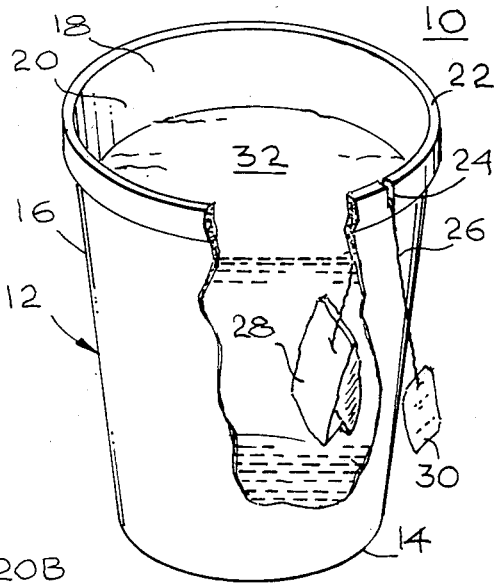
FIG. 3 is a schematic perspective view, partly broken away, showing the cup of FIG. 2, but with the tea bag thereof held suspended in the liquid therein by the tea bag string, such string being releasably secured in the cup's rim notch, with the bag tab on the outside of the cup.

The rim 22 at the upper end of sidewall 16 defines a vertical notch 24 therethrough. Notch 24 is of sufficient width to receive string 26 connected at one end to brewing bag 28 of tea, herb tea or the like (FIGS. 2 and 3) but of less width than that of terminal tab 30 connected to the opposite end of string 26. Notch 24 is shown in FIG. 3 releasably retaining string 26 and tab 30 so that bag 28 is suspended in brewing liquid 32 in space 18, and a portion of string 26 and all of tab 30 are disposed outside sidewall 16 and cannot be inadvertently dragged into cup 10, as during pouring of liquid 32 into cup 10, or during stirring of liquid 32, to assume the position shown in FIG. 2. Thus, tab 30 is always kept available in the dry state outside the cup, due to the string and tab-retaining function of notch 24, with which to withdraw bag 28 from space 18 after brewing is completed.

Stirring of liquid 32 during brewing and/or after addition of sugar and/or cream thereto will not dislodge tab 30 and string 26 from the position of FIG. 3, causing bag 28 to sink. Thus, bag 28 can be suspended in liquid 32 by string 26 in notch 24 at any desired level in cup 10 so that the entire surface area of bag 28 can be fully exposed to liquid 32 for the most rapid brewing of tea, etc. in cup 10. Moreover, when bag 28 is removed and cup 10 is later emptied, washed for reuse and inverted for drying, air passes into space 18 through notch 24 and wash liquid passes out of space 18 through notch 24 to speed the rate of drying of the interior of cup 10. Thus, notch 24 has a dual function.

Figure 8:
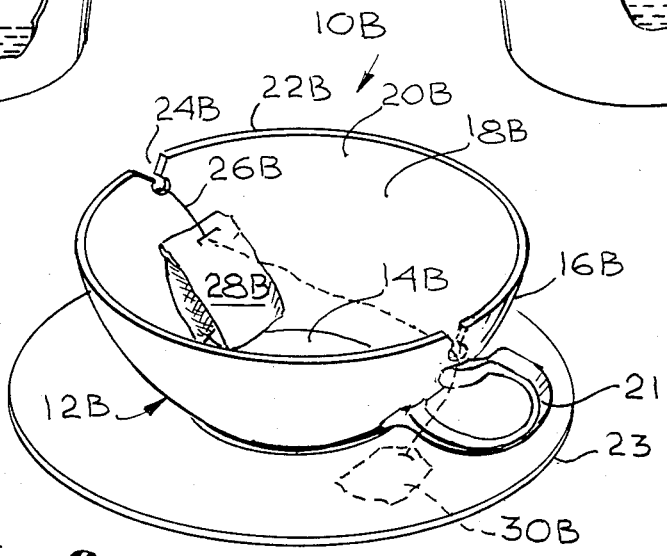
FIG. 8 is a schematic perspective view of a third preferred embodiment of the improved brewing cup of the present invention.

Cup 10 can be made of ceramic, metal, wood, glass, foamed plastic and the like, as a permanent or disposable item, and can include a cup handle, as in FIG. 8, if desired. Cup 10 can be of any suitable shape and size and is inexpensive to make.

FIGS. 4–6

Figure 4:
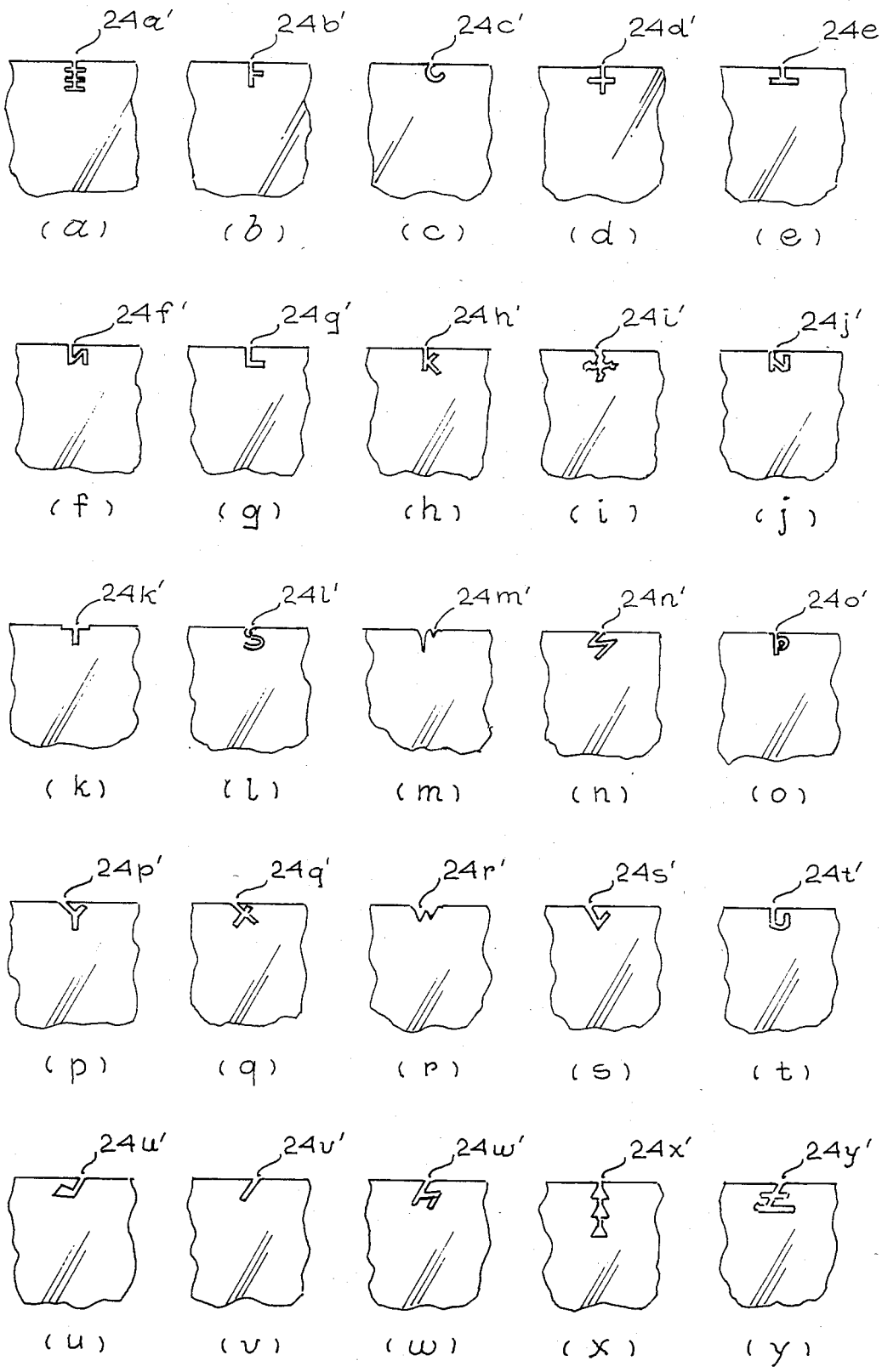
FIG. 4 schematically depicts in fragmentary side elevation (a) through (y) modified forms of the notch of the cup of FIG. 1.
Figure 5:
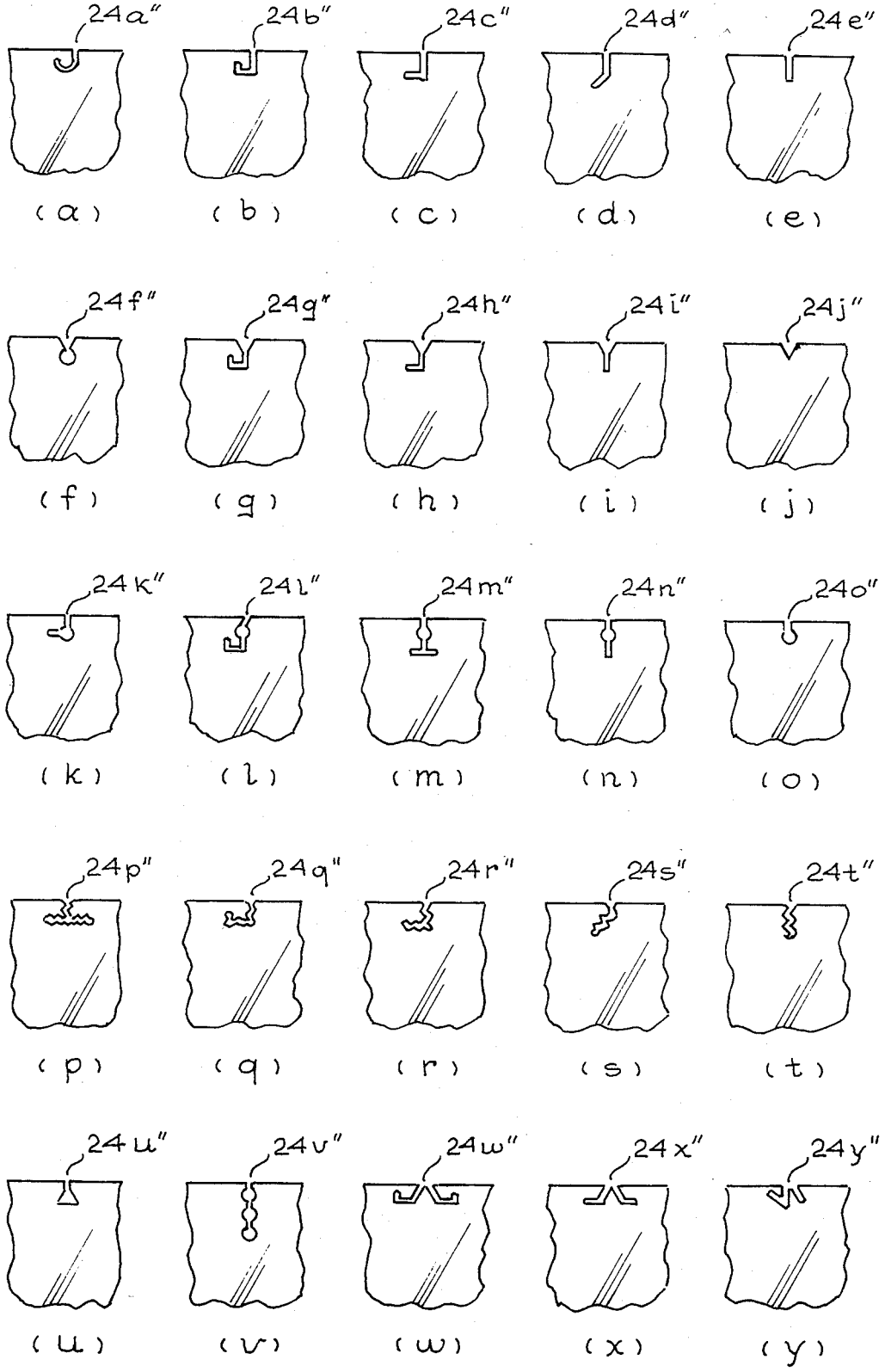
FIG. 5 schematically depicts in fragmentary side elevation (a) through (y) further modified forms of the notch of the cup of FIG. 1.
Figure 6:
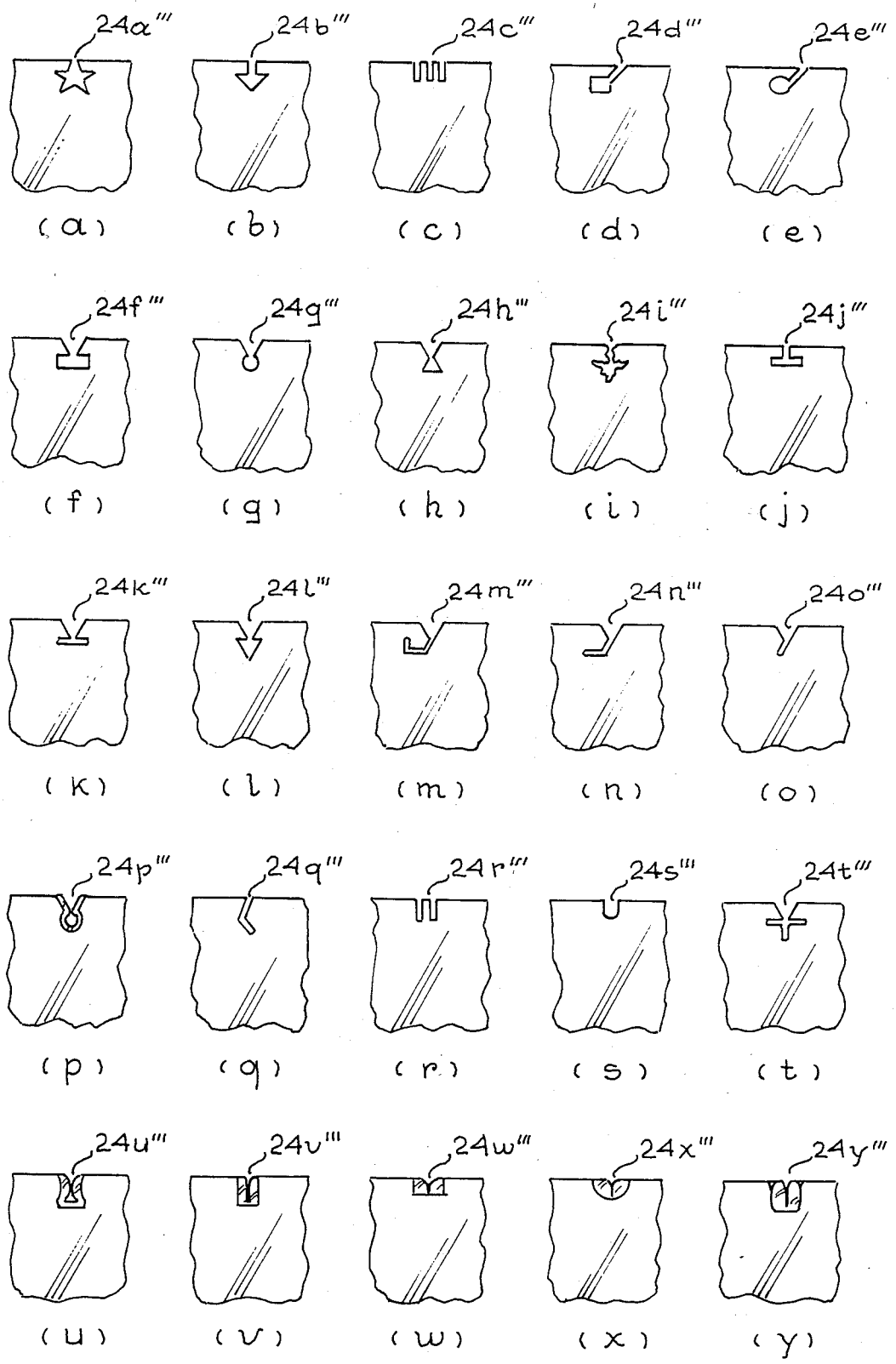
FIG. 6 schematically depicts in fragmentary side elevation (a) through (y) other modified forms of the notch of the cup of FIG. 1.

Now referring to FIGS. 4–6, various modified designs and configurations for rim notch 24 are depicted therein. Thus, notches 24*a'* through 24*y'* are shown in FIG. 4, while notches 24*a''* through 24*y''* are shown in FIG. 5 and notches 24*a'''* through 24*y'''* are shown in FIG. 6.

It will be noted that certain of such notches have upper vertical components (see, for example, notches 24*a'*, 24*b'*, 24*d'*, 24*e'*, 24*f'*, 24*g'* and 24*h'*) while others have upper slanted components (see, for example, notches 24*n'*, 24*p'*, 24*q'*, 24*r'*, 24*s'*, 24*u'*, 24*v'* and 24*w'*) and still others have upper curved components (see, for example, notches 24*c'*, 24*l'*, 24*r''*, 24*v''* and 24*x'''*). A number of the notches depicted in FIGS. 4–6 have widened lower components (see, for example, notches 24*a'''*, 24*b'''*, 24*e'''*, 24*f'''*, among others).

Finally, certain of the notches of FIGS. 4–6 are lined with flexible, resilient, string-gripping, memory-retaining, elastomeric material, such as natural or synthetic rubber or plastic (see, for example, notches 24*p'''*, 24*u'''*, 24*v'''*, 24*w''*, 24*x'''* and 24*y'''*). Such notch configurations as are represented by FIGS. 4–6 impart a distinctive appearance to cup 10 while providing the previously described string-retaining and cup draining functions. Two or more such configurations could, if desired, be spaced along the rim of cup 10.

FIG. 7

Figure 7:
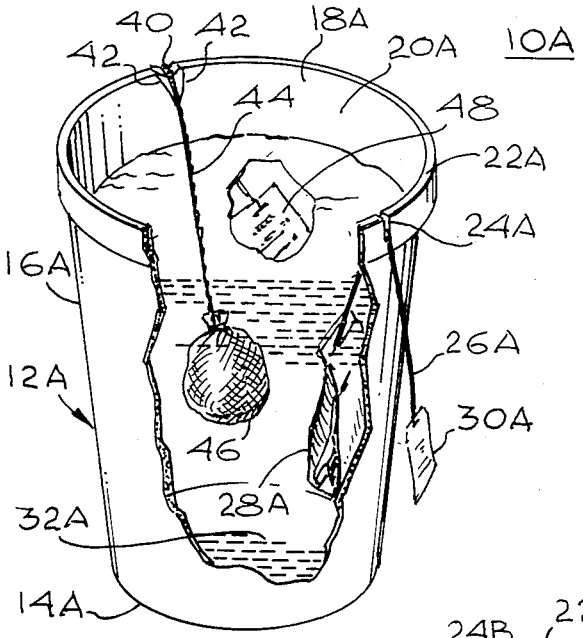
FIG. 7 is a schematic perspective view, partly broken away, of a second preferred embodiment of the improved brewing cup of the present invention, shown with two spaced notches, each releasably retaining a bag string, one of the notches being defined by a resilient elastomeric insert.

A second preferred embodiment of the improved brewing cup of the present invention is schematically depicted in FIG. 7. Thus, cup 10A is shown. Components thereof similar to those of cup 10 bear the same numerals but are succeeded by the letter "A". Thus, cup 10A comprises body 12A having bottom 14A, sidewall 16A, space 18A, top 20A, rim 22A and notch 24A.

Notch 24A releasably secures the string 26A which suspends tea bag 28A in liquid 32A while tab 30A is kept dry outside sidewall 16A. In this instance, body 12A is of formed polystyrene and notch 24A is initially very narrow so that string 26A must be forced thereinto to very slightly crush and/or deform rim 22A defining notch 24A and thus releasably lock string 26A in notch 24A.

Cup 10A also includes a second notch 40 spaced from notch 24A in rim 22A. Notch 40 is lined with and defined by a flexible, resilient, elastomeric insert 42 in rim 22A, which insert 42 releasably grips the string 44 of a second brewing bag 46 while keeping its string tab 48 dry and available outside sidewall 16A. Thus, cup 10A can accommodate both bag 28A and bag 46 at the same time as, for example, when it is desired to brew a mixture of different types of tea simultaneously in cup 10A.

FIG. 8

A third preferred embodiment of the improved brewing cup of the present invention is schematically depicted in FIG. 8. Thus, cup 10B is shown. Components thereof similar to those of cup 10 bear the same numerals but are succeeded by the letter "B". Thus, cup 10B comprises body 12B having bottom 14B, sidewall 16B, space 18B, top 20B, rim 22B and notch 24B. Cup 10B also has a handle 21 and is shown sitting on a conventional saucer 23. The notch 24B is located opposite the handle 21 so that the cup may be used with equal facility by either right-handed or left-handed persons without the notch 24B being in the way of drinking from the cup.

Notch 24B releasably secures the string 26B which suspends tea bag 28B within the cup as previously described while the tab (not shown) is kept dry and accessible outside sidewall 16B. In this instance, the notch 24B corresponds to the configuration 24*f''* of FIG. 5. The string 26B is loosely retained therein and is free to move longitudinally with the lower opening of notch 24B but the tab at the end of string 26B cannot slip through the notch into the cup.

It will be understood that cups 10, 10A and 10B could be glasses, mugs, urns, kettles or other similar brewing vessels and that they could be formed of various materials in various shapes and sizes.

Although there have been described above specific arrangements of an improved liquid brewing cup in accordance with the invention for the purpose of illustrating the manner in which the invention may be used to advantage, it wil be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An improved liquid brewing cup, said cup comprising, in combination:

(a) a closed bottom;

(b) a closed upraised sidewall secured to and defining with said bottom a central brewing liquid-receiving space, the upper end of said sidewall defining an exposed rim; and (c) an open top, said rim including means defining a brew bag string-receiving and retaining notch to prevent inadvertent passage of the length of said string and the bag string tab connected thereto into said brewing liquid space during pouring, brewing, stirring and drinking of liquid in said cup, said notch defining means including a lining surface of flexible, resilient, memory-retaining elastomeric material for releasably restraining the string in order to suspend the attached brew bag at a selected position within the cup above the bottom thereof.

2. The improved cup of claim 1 wherein said cup is a tea cup and wherein said notch has a generally vertical component which serves as a vent hole when said cup is inverted.

3. The improved cup of claim 1 wherein said cup is a tea cup and wherein said notch has a diagonal string-receiving opening.

4. The improved cup of claim 1 wherein said notch has a narrow upper portion and an expanded lower portion, said upper portion being sufficiently narrow relative to the thickness of a selected brew bag string as to permit the string to slide through said upper portion only upon the application of sufficient force to deform said portion.

5. The improved cup of claim 4 wherein said means defining said notch is readily deformable to accommodate bag strings of various diameters and to releasably grip said strings.

6. The improved cup of claim 5 wherein said cup is a tea cup comprising foamed plastic, including said notch-defining rim portion.

7. The improved cup of claim 1 wherein said restraining means comprises a V-shaped notch with converging side surfaces for frictionally engaging said string.

8. An improved liquid brewing cup, said cup comprising, in combination:

(a) a closed bottom;

(b) a closed upraised sidewall secured to and defining with said bottom a central brewing liquid-receiving space, the upper end of said sidewall defining an exposed rim; and (c) an open top, said rim including means defining a brew bag string-receiving and retaining notch to prevent inadvertent passage of the length of said string and the bag string tab connected thereto into said brewing liquid space during pouring, brewing, stirring and drinking of liquid in said cup, said notch defining means including means for releasably restraining the string in order to suspend the attached brew bag at a selected position within the cup above the bottom thereof, said restraining means comprising an insert positioned within the notch, said insert being formed of flexible, resilient memory-retaining elastomeric material for releasably gripping the bag string.

* * * * *